US007908898B2

(12) United States Patent
Meinig

(10) Patent No.: US 7,908,898 B2
(45) Date of Patent: Mar. 22, 2011

(54) METHOD AND DEVICE FOR THE INTEGRAL MOLDING OF A FLANGE TO THE END OF A ROUND OR OVAL PIPE OF THIN-WALLED SHEET METAL AND PIPE PRODUCED BY THE METHOD

(75) Inventor: Manfred Meinig, Rietheim-Weilheim (DE)

(73) Assignee: Metu Meinig AG, Rietheim-Weilheim (DE)

( * ) Notice: Subject to any disclaimer, the term of this patent is extended or adjusted under 35 U.S.C. 154(b) by 351 days.

(21) Appl. No.: 11/914,217

(22) PCT Filed: Jun. 29, 2006

(86) PCT No.: PCT/EP2006/006311

§ 371 (c)(1),
(2), (4) Date: Nov. 12, 2007

(87) PCT Pub. No.: WO2007/006424

PCT Pub. Date: Jan. 18, 2007

(65) Prior Publication Data

US 2008/0216539 A1 Sep. 11, 2008

(30) Foreign Application Priority Data

Jul. 8, 2005 (DE) ..... 10 2005 032 350

(51) Int. Cl.
*B21B 27/00* (2006.01)

(52) U.S. Cl. ..... 72/102; 72/101; 72/107; 72/121

(58) Field of Classification Search ..... 72/69, 101, 72/102, 105, 106, 107, 108, 109, 110, 111, 72/122, 124, 125, 120, 121, 379.4
See application file for complete search history.

(56) References Cited

U.S. PATENT DOCUMENTS

| | | | | |
|---|---|---|---|---|
| 1,807,531 | A | 5/1931 | Hopkins | |
| 2,469,775 | A * | 5/1949 | Lohmann | 72/69 |
| 3,015,294 | A * | 1/1962 | Lyon | 29/894.381 |
| 3,324,696 | A | 6/1967 | McDonald | |
| 3,672,317 | A * | 6/1972 | Halling et al. | 72/82 |
| 3,738,139 | A * | 6/1973 | Proops et al. | 72/69 |
| 4,578,007 | A * | 3/1986 | Diekhoff | 413/6 |
| 4,862,719 | A | 9/1989 | Kajrup et al. | |
| 6,161,409 | A * | 12/2000 | Friese | 72/110 |
| 6,644,083 | B2 * | 11/2003 | Pakker | 72/86 |

(Continued)

FOREIGN PATENT DOCUMENTS

| | | |
|---|---|---|
| DE | 649671 | 8/1937 |

(Continued)

*Primary Examiner* — Edward Tolan
(74) *Attorney, Agent, or Firm* — Akerman Senterfitt; Peter A. Chiabotti

(57) ABSTRACT

The invention proposes a method for the integral molding of a flange (5) onto the end of a round or oval pipe (11) of thin-walled sheet metal. This method takes place in two stages. In a first stage, for the purpose of accumulating material, a sectionally circular or spiral-shaped bead (17) is molded on by means of a pre-forming roller tool (9), comprising a combination of rollers (13 to 15) (Figure a). In a second stage, the molded-on bead is compacted with the aid of a final-forming roller tool (18), comprising the rollers (19) and (20), to produce an at least partly solid flange (5) (Figure b).

8 Claims, 20 Drawing Sheets

U.S. PATENT DOCUMENTS

| | | | | |
|---|---|---|---|---|
| 7,073,826 | B2 | 7/2006 | Meinig | |
| 7,121,129 | B2 * | 10/2006 | Binggeli | 72/110 |
| 2003/0193186 | A1 | 10/2003 | Meinig | |
| 2004/0089043 | A1 | 5/2004 | Meinig | |
| 2006/0186665 | A1 | 8/2006 | Meinig | |

FOREIGN PATENT DOCUMENTS

| | | |
|---|---|---|
| EP | 1167222 | 1/2002 |
| GB | 235979 | 7/1925 |
| JP | 1-99735 | * 4/1989 |
| JP | 2178523 | 11/2007 |

* cited by examiner

METHOD AND DEVICE FOR THE INTEGRAL MOLDING OF A FLANGE TO THE END OF A ROUND OR OVAL PIPE OF THIN-WALLED SHEET METAL AND PIPE PRODUCED BY THE METHOD

CROSS REFERENCE TO RELATED APPLICATION

This application is a §371 National Phase of PCT/EP2006/006311, filed Jun. 29, 2006, the entirety of which is hereby incorporated by reference.

BACKGROUND OF THE INVENTION

Pipes made of thin-walled sheet metal are typically composed of sub-sections that are connected to one another. The method of connection crucially influences how economically the sub-sections can be produced and assembled. This also applies to pipe-shaped devices or devices comprising pipe-shaped connections, which must frequently be integrated in such pipes, and to pipe-shaped apparatuses comprising sub-sections.

With respect to the methods of connection, a differentiation is made between plug connections, which are predominantly used for smaller diameter pipes comprising sub-sections, and flanged connections. For these flanged connections, in general separate flanges are produced, which are screwed, riveted, welded or otherwise attached to the pipe end.

The flanges are produced by forming of the pipe end only in some cases.

The simplest way of an integrally formed flange is the stay flange, which is obtained by folding the edge of the pipe end at a right angle. In addition, crimpings are known, which are produced by rolling the pipe end into a bead that is substantially circular in its cross-section.

To connect these flanges configured as stay flanges or crimpings, tensioning rings having a U- or V-shaped cross-section are used, the clearance width of these rings being adjusted to the cross-section of the flanges bearing on one another. The tensioning rings must be considerably rigid because neither the stay flange nor the crimping sufficiently brace the pipe at the end in the radial direction. Higher radial rigidity is achieved with such integrally formed flanges that are created by folding up the pipe end twice at a right angle. Flanges of this type are used primarily for device housings, particularly the housings of radial fans. The flanges are connected to one another mostly be screws that are distributed across the circumference.

One of the more recent publications includes a method known from DE 100 47 310 A1 for integrally forming a flange to the end of a thin-walled pipe, which is first bent upward by 150° and then by 90°, thus creating a flange with a conical outer surface. The flanges bearing on one another on the abutment site of two pipe pieces can be connected by means of a tensioning ring having a V-shaped cross-section.

Due to drastically increased requirements with respect to tightness and smooth inside surfaces, particularly for the air ducts in ventilation, air conditioning and exhaust technology, increasingly pipes with integrally formed flanges are used. The disadvantage, however, is that the strength of the material forming the flange automatically only corresponds to the pipe wall thickness, which is frequently not sufficient for the required stability. To reinforce the flange, it has therefore been proposed, for example according to DE 102 15 112 C1, to slide a reinforcing ring on the end of the pipe section used for forming the flange, the ring doubling the wall thickness of the flange.

Frequently, however, even this type of reinforcement is not sufficient and not satisfactory.

It is therefore the object of the present invention to provide a method and a device for the integral forming of a flange to the end of a round or oval pipe made of thin-walled sheet metal, which allow a considerably stronger and considerably more stable flange to be produced. Such an object is achieved in that in a first stage, for the purpose of accumulating material, the end of an axial sub-section of the pipe is formed into a bead, while axially advancing a pre-forming roller tool at the same time, whereupon in a second stage the bead is compressed by means of a final-forming roller tool to produce a solid flange.

SUMMARY OF THE INVENTION

With this method, which can be performed using comparatively simple tools, solid or partly solid flanges being considerably thicker than the wall thickness of the pipe can be produced.

In the simplest case, the pre-forming roller tool is advanced enough that a bead having a substantially circular cross-section and at least one layer is produced, which is formed into a partly solid flange in the second stage.

If, the pre-forming roller tool is advanced so far that a bead having a substantially spiral-shaped cross-section and at least two layers is produced, in the second stage this bead can be compressed into a substantially solid flange.

If the advancement of the pre-forming roller tool occurs after the bead has been formed, the wall of the bead is compressed, thus creating a flange with higher density during the subsequent final-forming step.

According to this method, a round or oval pipe made of thin-walled sheet metal comprising an integrally formed, at least partly solid flange can be produced, which, is thicker than the wall thickness of the pipe and preferably has a rectangular, square, triangular or trapezoidal cross-section with rounded edges.

For example, it is possible to produce a flange for a pipe having a wall thickness in the range of 0.5 to 5 mm, the mean thickness of this flange measured in the axial direction of the pipe corresponding to two to ten times the thickness of the pipe wall.

So as to perform the method, a device is proposed, which comprises a pre-forming roller tool for producing the bead, a final-forming roller tool for producing the solid flange as well as a clamping device for the pipe. The roller tools are disposed non-rotatably, but radially and axially displaceably, and the motor-driven clamping device for the pipe is disposed rotatably, but axially non-displaceably on a mount.

In this device, the pipe to be provided with a flange revolves, while the roller tools are advanced axially in relation to the pipe.

In another exemplary embodiment, the roller tools are disposed jointly on a motor-driven, rotatably mounted rotary table such that they are radially and axially displaceable, while the clamping device for the pipe is provided on the mount such that it is not axially displaceable and not rotatable.

During the production of the flange using the device, the roller tools revolve around the braced pipe, while being axially advanced at the same time.

The configuration of the pre-forming roller tool is described herein.

The final-forming roller tool is also described herein.

Further design details of the roller tools are disclosed herein.

For clamping of the pipe, a clamping device is suited, in which radially displaceable jaws rest against the inside pipe wall in a force-fit manner.

In another embodiment, an elastic spring-loaded disk can be used for clamping, the tensioning finger of the disk likewise engaging the inside wall of the pipe in a force-fit manner.

Design measures, for example for actuating the clamping device or the drive of the tensioning device are characterized herein.

A pressure ring is proposed herein for clamping relatively thin-walled pipes.

To make production even more economical, a device is suited, which simultaneously molds flanges onto both pipe ends, as is described in detail herein.

The inventive device for producing pipes from sheet metal comprising integrally formed flanges according to the present invention is particularly suited for fully automatic production. For this purpose, a programmable circuit is required for controlling the drive mechanisms, valves and similar units based on defined manufacturing procedures.

BRIEF DESCRIPTION OF THE DRAWINGS

Details of the method as well as of the device for the integral forming of a flange to the end of a round or oval pipe as well as the pipes produced by this method are described hereinafter with reference to the exemplary embodiments illustrated in the figures, wherein.

DETAILED DESCRIPTION OF THE PREFERRED EMBODIMENTS

Figure 1:
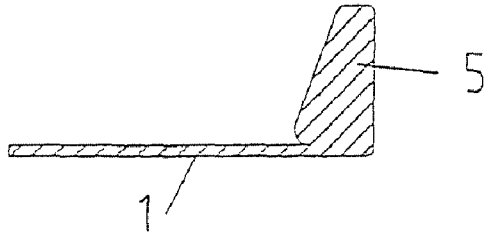
FIG. 1 to FIG. 4 are longitudinal sectional views of the pipe with comprising the integrally formed flange.
Figure 2:
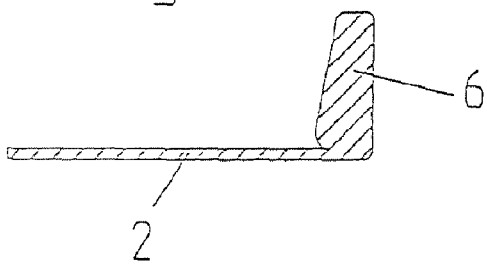
Figure 3:
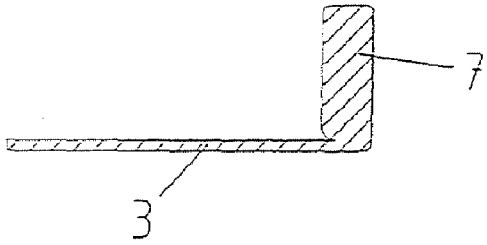
Figure 4:
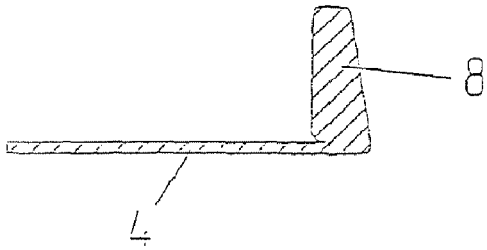
Figure 5:
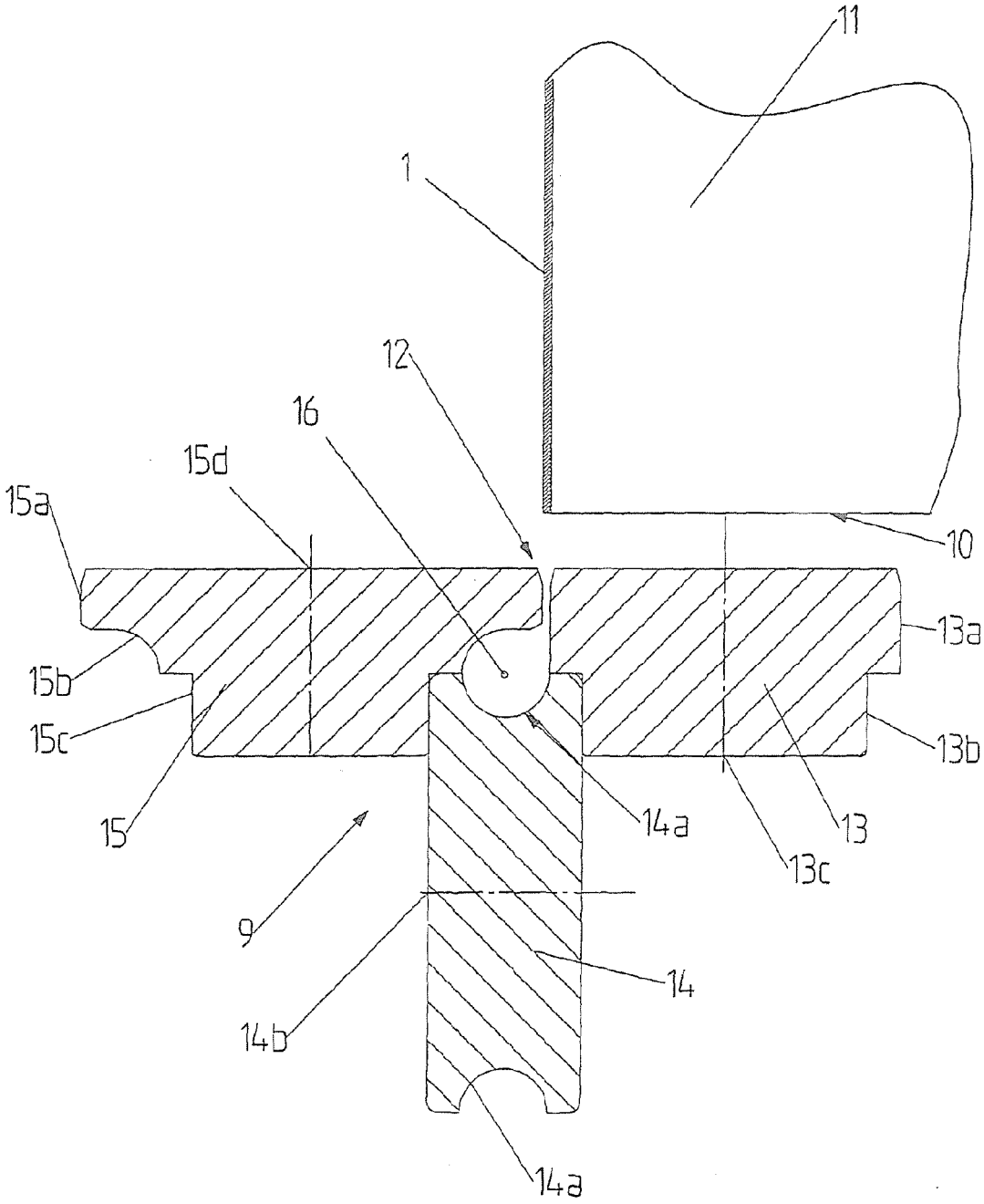
FIG. 5 to FIG. 12 are longitudinal sectional views of the pre-forming roller tool with the end of the pipe to be provided with a flange in various processing stages.

FIGS. 1 to 4 illustrate four different possibilities of solid flanges that can be produced according to the invention. As the figures show, flanges 5 to 8 are integrally formed on the pipe walls 1 to 4 of a pipe, which is not shown in detail, the flanges being partly solid or solid depending on the compression. These flanges may have nearly arbitrary cross-sectional shapes. Preferred are flanges with a trapezoidal cross-section 5, 6 or 8, or flanges with a rectangular cross-section 7, which are particularly suited for an assembly with tensioning rings. The material accumulation in the flange profile produces extraordinarily high radial and axial flange rigidity.

The production of these flanges occurs by forming the pipe end 10 of the pipe 11 in a two-stage process:

In the first stage, which is explained based on FIGS. 5 to 12, first the end 10 of the pipe 11 is formed into a bead 17 by means of a special rolling method.

In a second stage, which is explained based on FIGS. 13 to 17, this preformed bead is compressed into the desired shape of the solid or partly solid flange using a special milling method.

To produce the bead, the pre-forming roller tool 9 is used, which comprises the rollers 13 and 15, which are disposed axially parallel, and the roller 14, which is disposed with the axis 14*b* thereof perpendicular to the axes 13*c* and 15*d*. The roller 13 is shaped such that it comprises at the upper end thereof a substantially cylindrical section 13*a* and connected thereto a likewise cylindrical section 13*b* having a smaller diameter.

The profiled roller 15 at the upper end thereof likewise comprises a cylindrical section 15*a* and connected thereto an annular groove 15*b* having a quarter-circle cross-section and connected thereto a cylindrical section 15*c* having a smaller diameter.

The third roller of the roller combination 9 disposed in T-shape is provided and dimensioned such that it engages the space between the cylindrical sections 13*b* and 15*c*. This roller 14 has an annular groove 14*a* with a semi-circular cross-section. As the figure shows, the annular grooves 14*a* and 15*b* together with the cylindrical section 13*a* form a formed groove 16 with a circular cross-section, wherein the diameters of the sections 13*a* and 15*a* are dimensioned such that a receiving gap 12 remains between the rollers 13 and 15, the clearance width of the gap corresponding to the thickness of the pipe wall 1.

Figure 6:
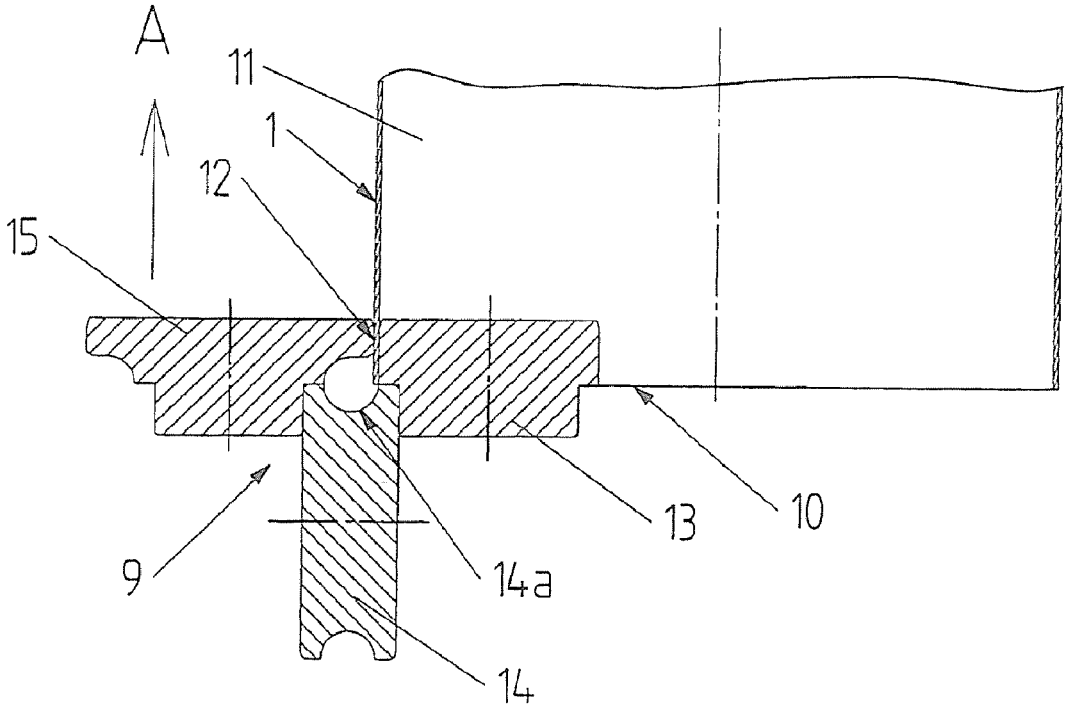

So as to produce the bead in the first stage of the method, the pipe 11 is rotated in relation to the pre-forming roller tool 9 or the pre-forming roller tool 9 in relation to the pipe 11, wherein the pre-forming roller tool 9 or the pipe 11 is displaced in the axial direction A toward the pipe 11 or the pre-forming tool 9. The wall 1 is inserted in the gap 12 between the rollers 13 and 15 until it comes in contact with the semi-circular formed groove 14*a* of the roller 14, which is shown in FIG. 6.

Figure 7:
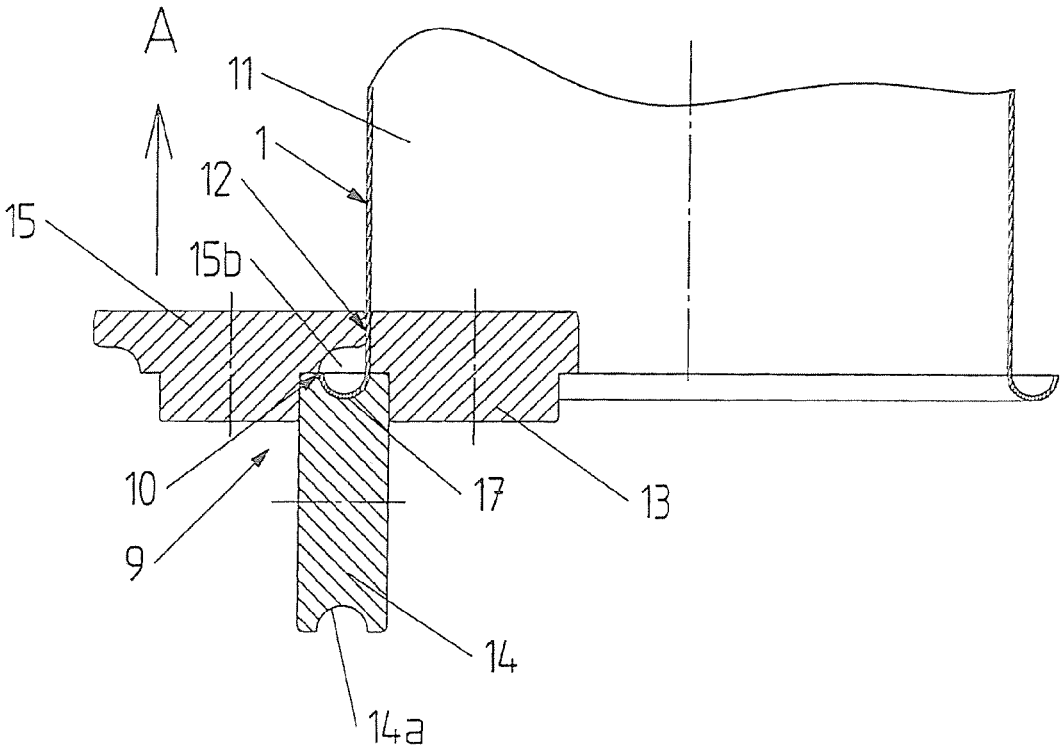
Figure 8:
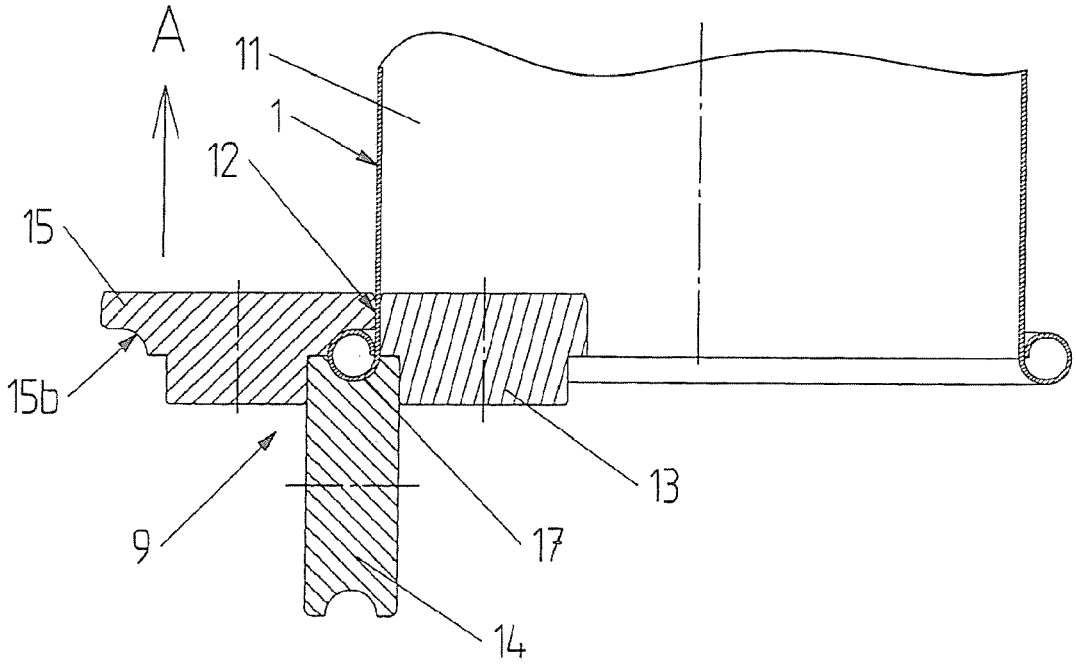

During further advancement of the pre-forming roller tool 9 or of the pipe 11, the outer edge 10 of the pipe wall 1 is beaded by means of the annular groove 14*a* of the roller 14 into a substantially semi-circular bead 17, which is shown in FIG. 7. During further advancement of the roller tool 9 in the direction A or of the pipe 11, the outer edge 10 of the pipe 11 is inserted in the annular groove 15*b* of the roller 15, the groove having a quarter-circle cross-section, thus forming the edge 10 into a bead having a circular cross-section. This stage of the method is illustrated in FIG. 8.

Figure 9:
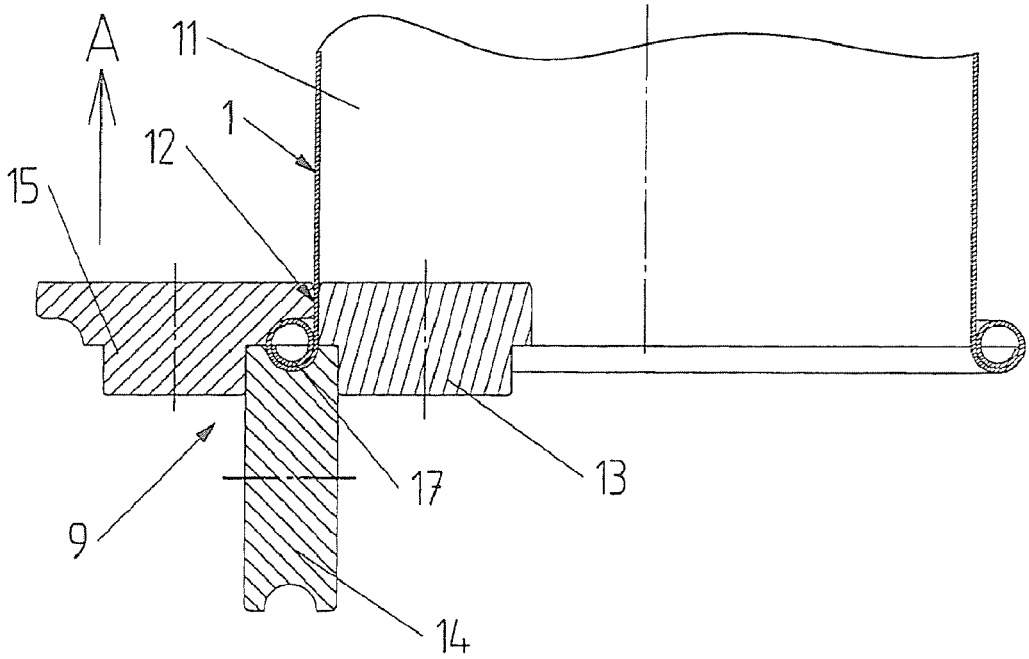
Figure 10:
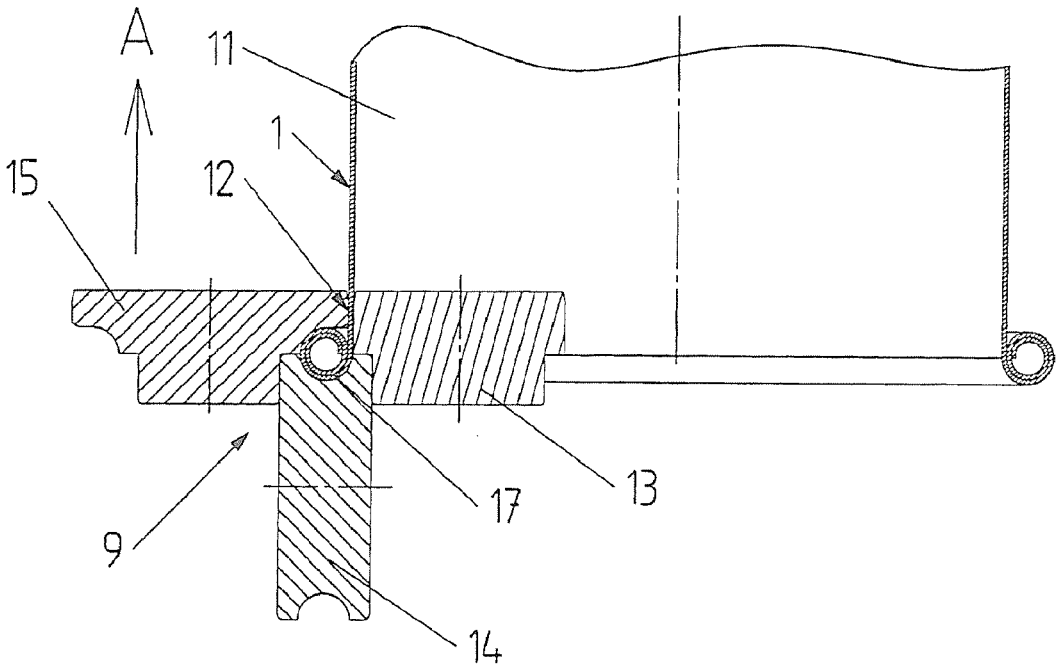
Figure 10A:
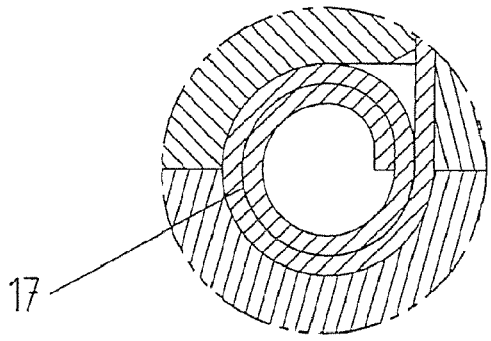
FIGS. 10*a*, 11*a* are enlarged details according to FIG. 10 and FIG. 11, FIG. 13 to FIG. 17 are longitudinal sectional views of the final-forming roller tool with the end of the pipe to be provided with a flange in various processing stages.

If the advancement of the roller tool 9 is continued in the direction of the arrow A or of the pipe 11—of course with continued relative rotation of the roller tool and pipe 11—the bead 17 initially having a substantially circular cross-section becomes a bead 17 having a substantially spiral-shaped cross-section, as is illustrated in FIGS. 9, 10 and 10*a*.

This bead per se is already suited for the production of a partly solid flange in the second stage.

Figure 11:
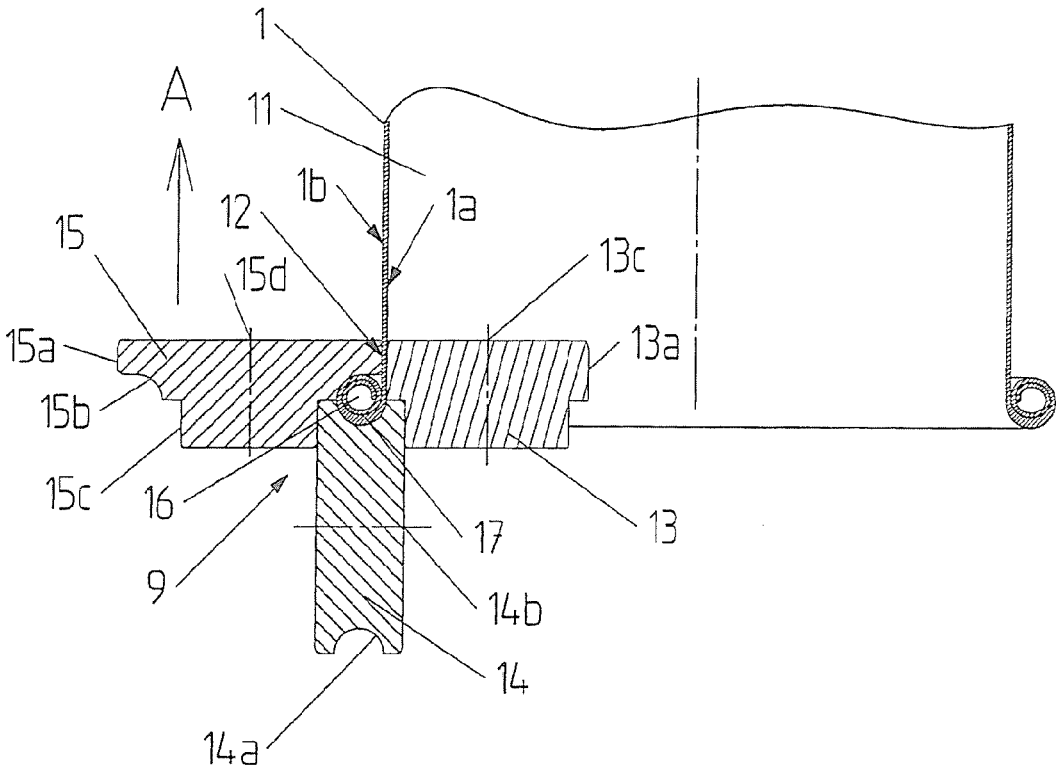
Figure 11A:
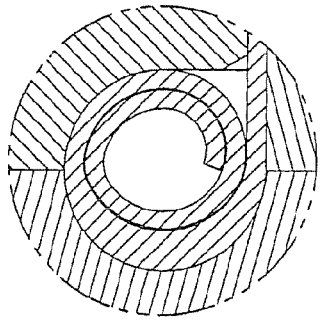
Figure 12:
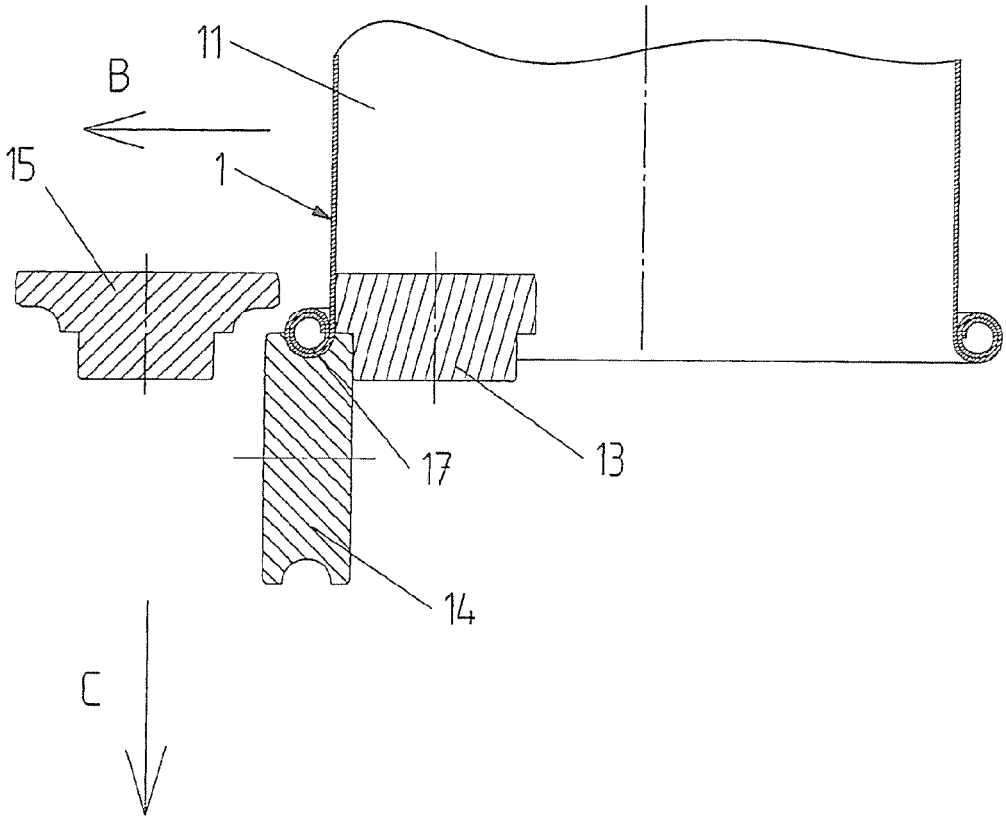

If higher material density for a solid flange is to be achieved, the axial advancement of the pre-forming roller tool 9 in the direction of the arrow A or of the pipe 11 is continued from the position shown in FIGS. 10 and 10*a*. Since no further crimping occurs due to the higher rolling resistance, the outer windings of the bead 17 are compressed due to the containment in the formed groove 16, which prevents the material from giving way, so that the material thickness of the bead windings increases, as FIGS. 11 and 11*a* show.

The advancement of the pre-forming roller tool 9 or of the pipe 11 is ended when a sufficient amount of material of the outer edge 10 of the pipe has been formed and compressed to achieve the necessary rigidity of the flange.

After completion of the axial advancement of the pre-forming roller tool 9 or of the pipe 11 as well as the relative rotation between the pre-forming roller tool 9 and the pipe 11, the roller 15 is moved radially away from the pipe 11 in the direction of the arrow B and braced to complete this first stage. Thereafter, the rollers 13 and 14 are pulled back, together with the roller 15, in the opposite direction of the advancement direction and parallel to the axis of the pipe 11, which is to say in the direction of the arrow C, into the starting position where they remain until the next pipe is processed.

It is not until during the next processing operation that the roller 15 is again retracted radially in the opposite direction of the arrow B, is braced and then axially advanced, together with the rollers 13 and 14, in the opposite direction of the arrow C.

So as to produce the bead for pipes made of sheet metal having a wall thickness of 0.5 mm to 5 mm, a speed in the range 0.1 to 2 mm per pipe revolution has proven advantageous for the axial advancement of the pre-forming tool 9 or of the pipe 11.

The second stage until the completion of the partly solid or solid flange will be explained with reference to FIGS. 13 to 17.

Figure 13:
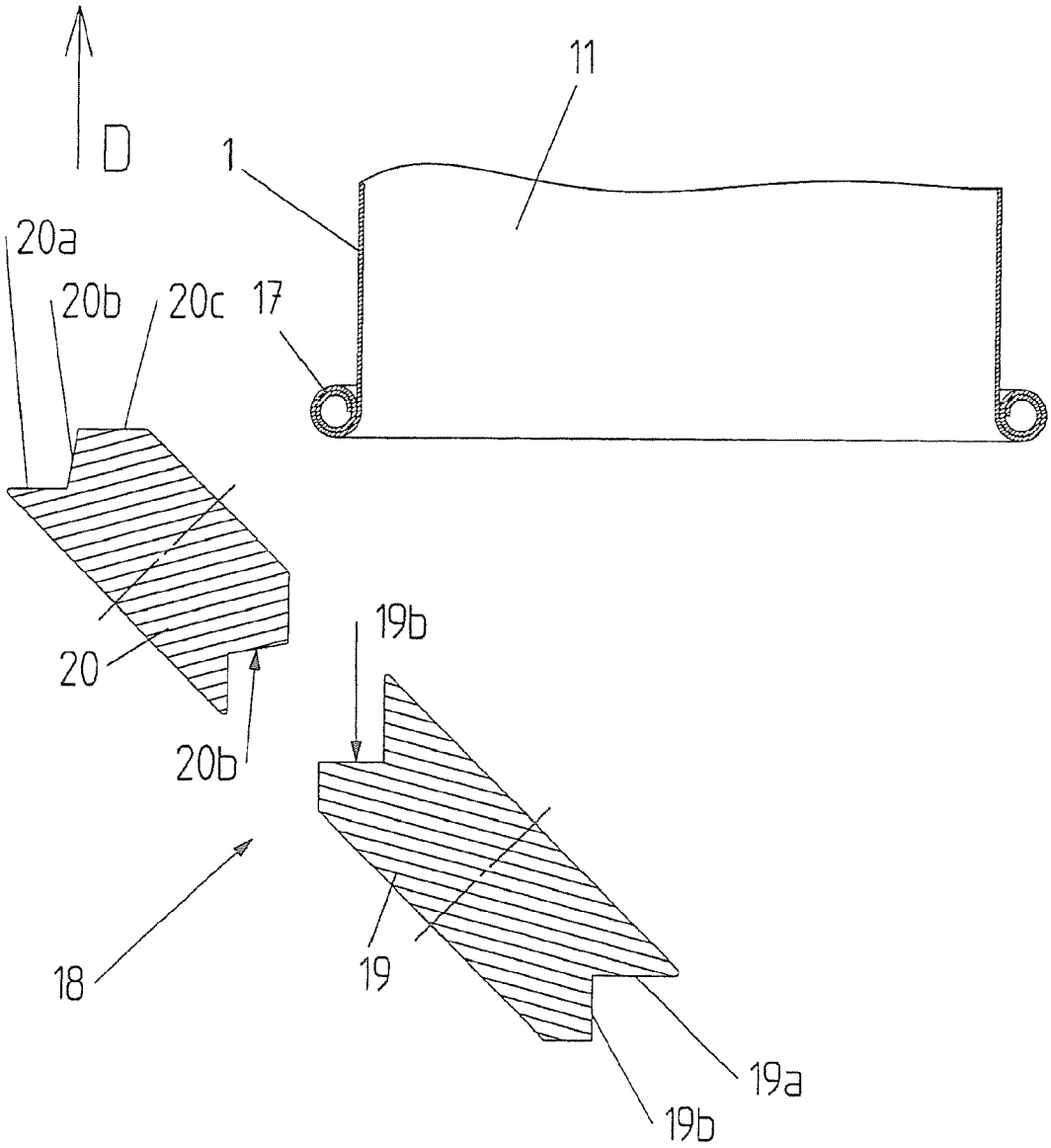
Figure 16:
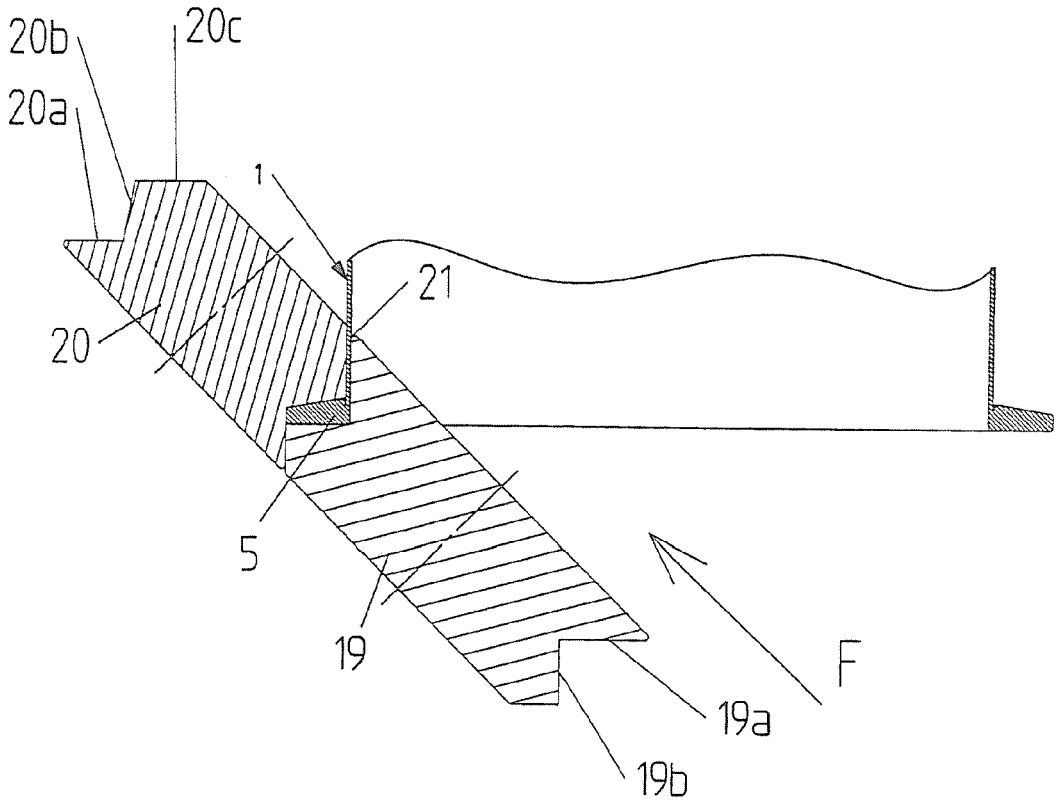

The final-forming roller tool 18 comprises two profiled rollers 19 and 20, which are angularly displaceable in relation to one another and with respect to the wall 1 of the pipe 11 from the position shown in FIG. 13 such that ultimately they assume the final position shown in FIG. 16.

The rollers 19 and 20 comprise annular grooves having a substantially V-shaped cross-section, the grooves being limited by the annular surfaces 19*a* and 19*b* or 20*a* and 20*b*, which are disposed at an angle in relation to one another.

These annular surfaces are disposed and dimensioned such that they form a space that corresponds to the desired cross-section of the flange 5 as well as a required receiving gap 21 for the pipe wall 1 in the final position of the forming rollers 19 and 20, which is shown in FIG. 16.

Figure 14:
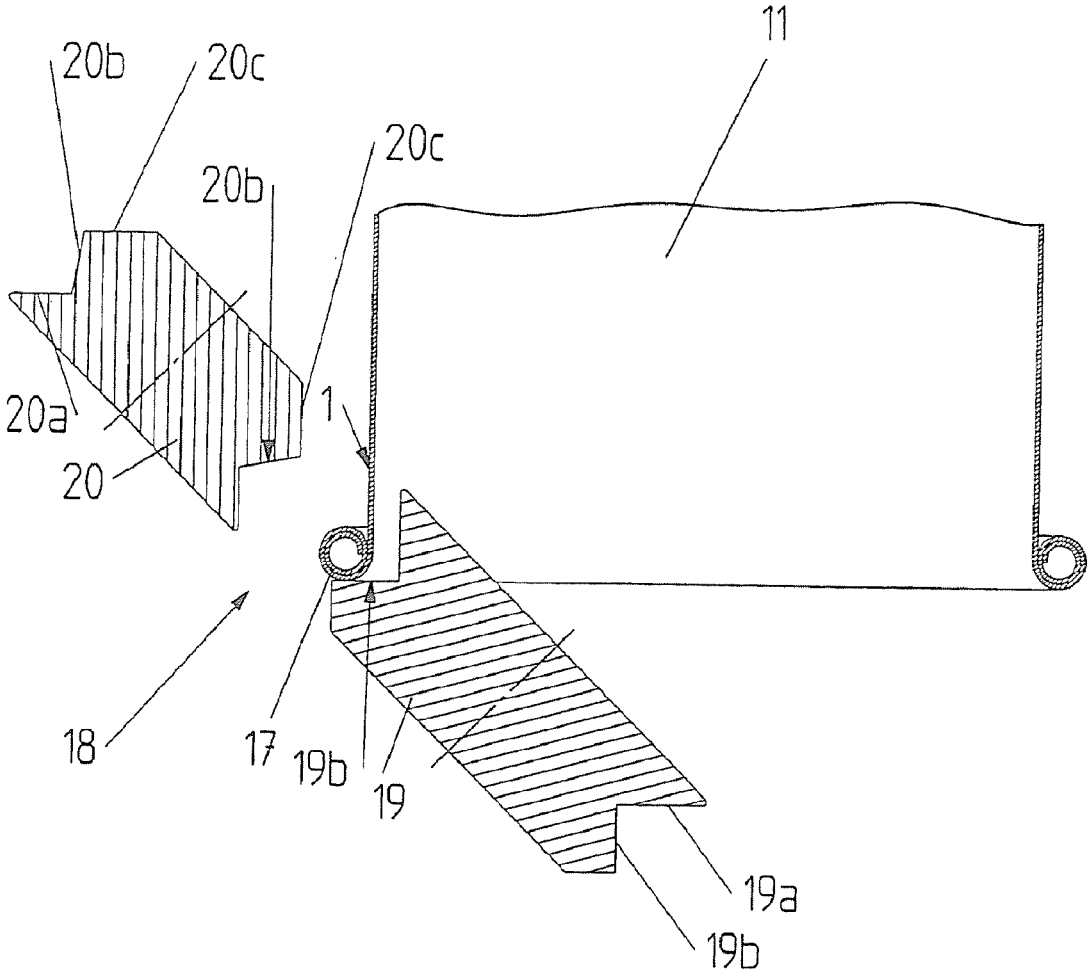
Figure 15:
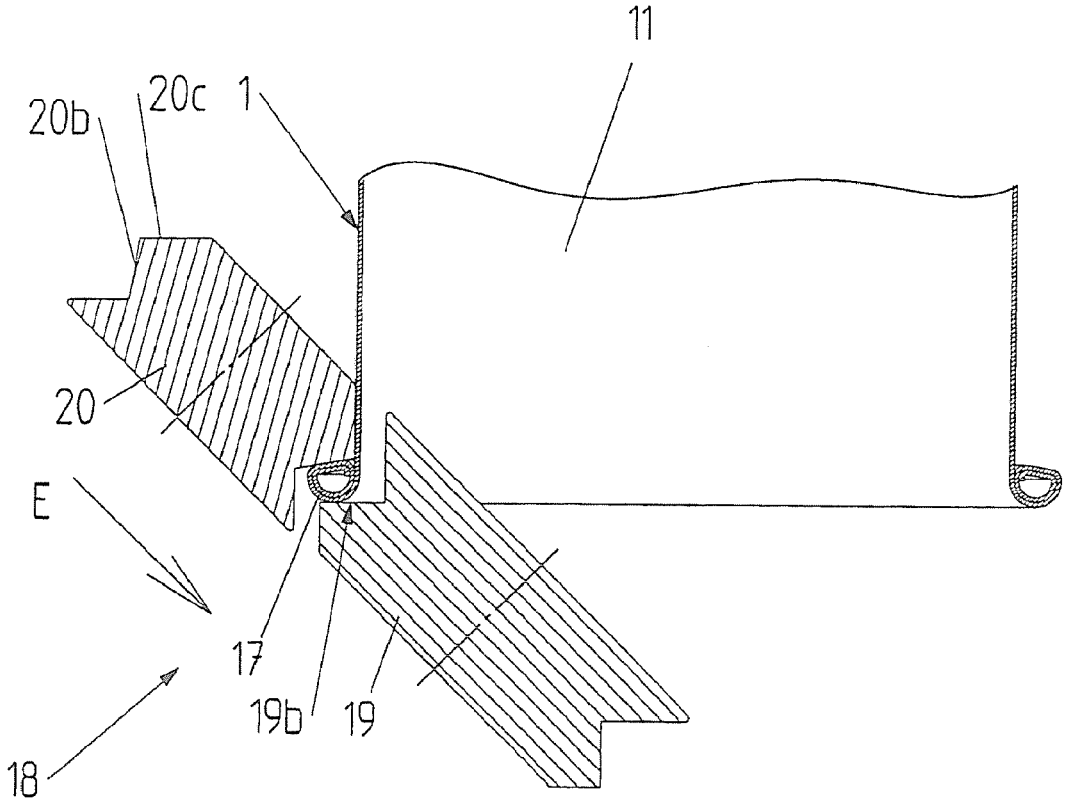

In the finishing stage of the flange, the rollers 19 and 20 are displaced jointly from their position shown in FIG. 13 toward the bead 17 of the pipe 11, initially parallel to the pipe axis in the direction of the arrow D, until the roller 19 with the annular surface 19*b* thereof comes in contact with the lower edge of the bead 17, which is shown in FIG. 14. Then, the roller 20 is displaced obliquely in the direction of the arrow E, which is to say against the pipe wall 1 and the bead 17, until it comes in contact with the annular surface 20*c* thereof with the wall 1 and with the annular surface 20*b* with the top of the bead 17, which is shown in FIG. 15. The bead is hereby deformed to form the inner beveled surface of the flange. The roller 20 is locked in this position. The continued forming of the flange occurs by means of the forming roller 19, which is now obliquely displaced from the position shown in FIG. 15 in the direction of the arrow F against the locked roller 20 until the annular surface 19*a* thereof comes in contact with the inside of the pipe wall and has compressed the bead by means of the annular surface 19*b* into the flange 5 shown in FIG. 16.

Depending on the dimensions of the annular surfaces 19*a* and 19*b* or 20*a* and 20*b*, flanges with different profiles and different dimensions can be produced.

Figure 17:
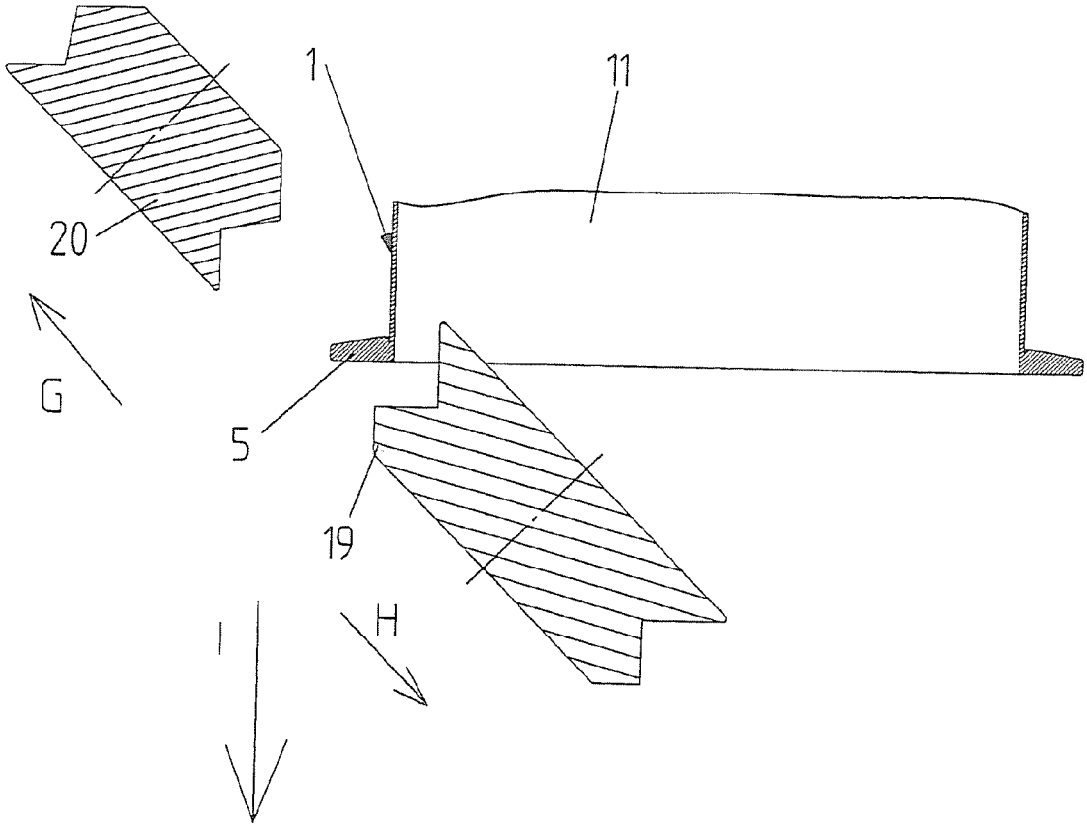

After the flange 5 has been completed, the rollers are retracted from the position shown in FIG. 16, initially in the directions of the arrows G and H, as is shown in FIG. 17.

The rollers 19 and 20 of the final-forming roller tool 18 can now be jointly retracted in the opposite direction of the advancement direction parallel to the pipe axis in direction of the arrow I into the starting position. They are ready for another finishing operation.

For the advancement directions E and F an angle of approximately 45° has proven advantageous. Angles in the range of 45°±3° are also still practical. For angles outside of this range, however, the material forming result is inadequate.

As in the first stage, in the second stage the rollers are not driven, instead they revolve freely.

They must be mounted both radially and axially such that they tolerate high stresses. For this, in particular tapered roller bearings are suited.

The speed for the axial advancement of the final-forming roller tool 18 or of the pipe 11 advantageously ranges between 0.1 and 2 mm per revolution of the pipe or the tool 18.

The dimensions of the rollers of the pre-forming roller tool and of the rollers of the final-forming roller tool as well as the axial advancement during the pre-forming operation must be matched such to each other that partly solid or solid flanges with rounded edges are produced.

If the ratios are not correct, flanges with sharp edges or even flanges with burrs or hollow flanges are produced.

In principle, if the tools are dimensioned correctly, nearly any flange cross-section can be produced regardless of the pipe wall thickness, with wall thicknesses in the range from 0.5 to 5 mm being preferred. As a result, the method can also be used for the production of flanges for pipe-like devices and apparatuses.

Figure 18:
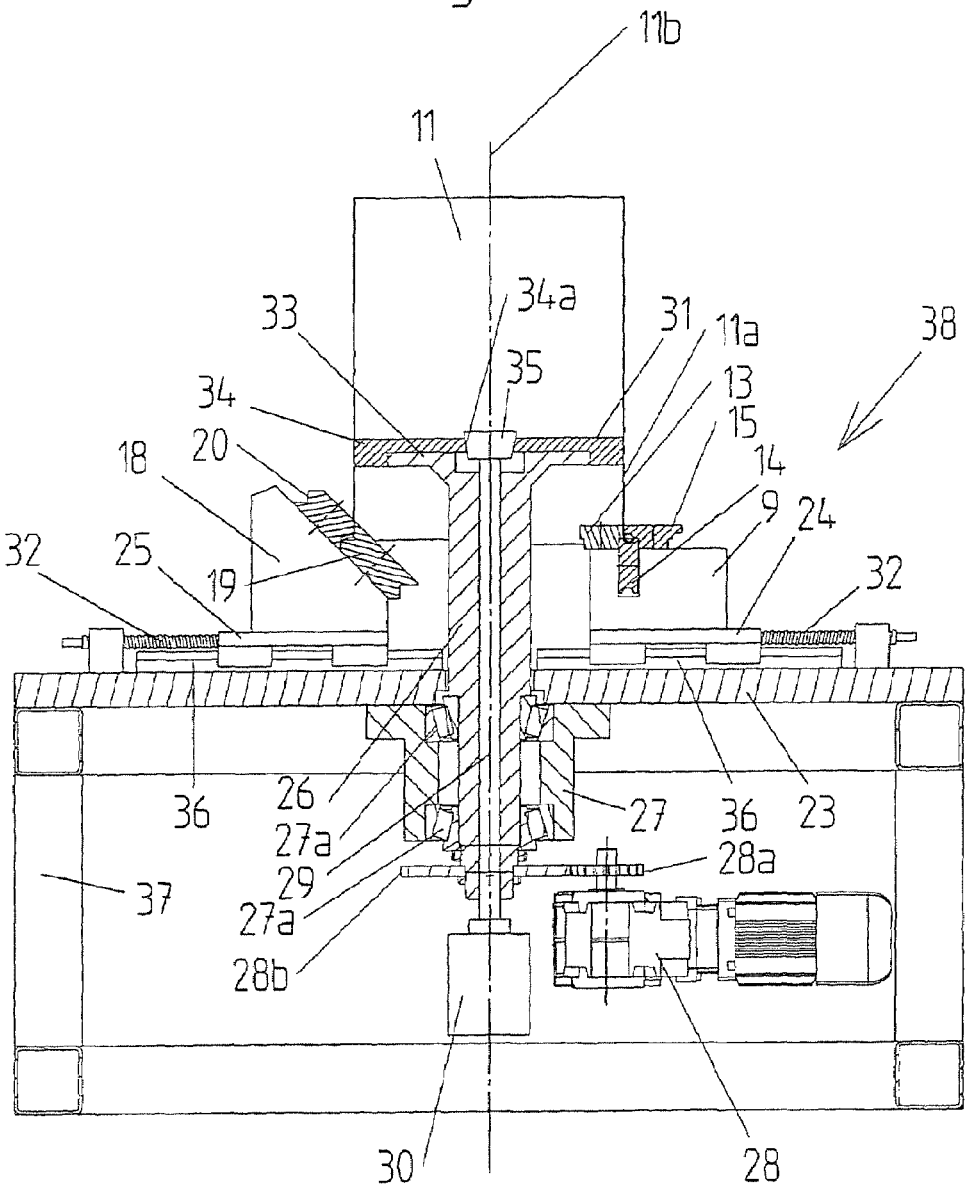
FIG. 18 is an axial section of a complete device for the integral forming of a flange according to the first exemplary embodiment.
Figure 19:
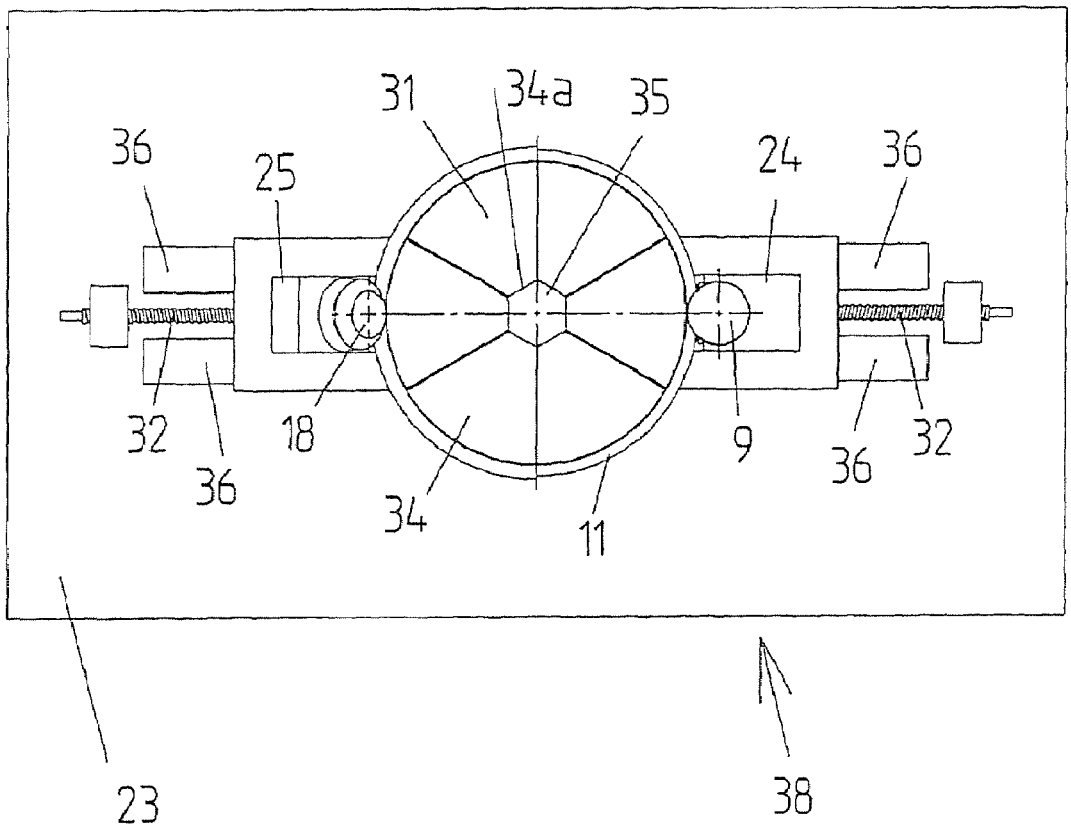
FIG. 19 is a top view of the device according to FIG. 18.

A first exemplary embodiment of a complete device for integrally forming a flange to a pipe 11 is illustrated in FIGS. 18 and 19. In this device, the roller tools 9 and 18, which were explained in detail with reference to FIGS. 5 to 17, are provided radially displaceably on tool carriages 24 and 25 at the base plate 23 of a mount 37. Adjusting spindles 32 serve the radial adjustment. The rollers 13 to 15 of the pre-forming roller tool 19 and the rollers 19 and 20 of the final-forming roller tool 18 are mounted axially and radially displaceably on the respective carriages 24 and 25 by means of advancing devices, which are not shown, in the manner explained with reference to FIGS. 5 to 17.

In the exemplary embodiment according to FIG. 18, the pipe 11 performs a rotary motion in relation to the mount 37 in order to produce the flange, while the carriages 24, 25 carrying the roller tools 9 and 18 are stationary. The carriages 24 and 25, which are radially displaceable by means of the adjusting spindles 32 or optionally by means of pneumatic or hydraulic cylinders, are connected to the base plate 23 of the mount 37 by means of sufficiently stable and precise guide rails 36. The freely revolving rollers 13 to 15 of the pre-forming roller tool 9 or 19 and 20 of the final-forming roller tool 18 are mounted in blocks provided on the carriages 24 and 25 and can be displaced by means of guides, which are not shown, in the manner explained with reference to FIGS. 5 to 17. Hydraulic or pneumatic cylinders integrated in the blocks, or threaded spindles with gear or servo motors, serve as the drive mechanisms, but are not shown.

For clamping the pipe 11, a tensioning disk denoted with reference numeral 31 is used, which comprises a base disk 33 with tensioning segments 34 mounted radially displaceably thereon in a radial shape, which is shown in more detail in the top view according to FIG. 19. The base disk 33 is carried by a central hollow shaft 26, which is mounted in the bearing block 27 attached to the bottom of the base plate 23. The tapered roller bearings 27*a* of this bearing block 27 absorb the extremely high radial and axial loads.

So as to actuate the tensioning disk 31, a pull rod 29 extending through the hollow shaft 26 is provided, at the upper end thereof a tensioning cone configured as a conical polygonal bolt 35 is attached, which rests against the inside jaw ends 34*a* of the jaws 34. During the downward axial displacement of the pull rod 29 by means of a double-action cylinder 30, the jaw segments 34 are consequently displaced radially outward and rest against the inside wall of the pipe 11 to be clamped in a force-fit manner. To detach the pipe 11, the pull rod 29 is displaced in the opposite direction by means of the cylinder 30. Return springs, which are not shown and are installed in the jaw segments 34, ensure the return of the jaw segments 34, so that the pipe 11 is released.

A drive motor 28 disposed in the mount 37 serves the rotary drive of the clamping device, the pinions 28*a* of the motor engaging a gear wheel 28*b* provided on the inner end of the hollow shaft 26.

Instead of gear wheel drives also chain or toothed belt drives are suited.

Using the device according to FIGS. 18 and 19, the production process is as follows.

Before starting production, the pre-forming and final-forming roller tools 9 and 18 are adjusted by means of the carriages 24 and 25 to the diameter of the pipe section 11 to be provided with a flange and moved to the base position explained with reference to FIGS. 5 to 17.

The pipe 11 is pushed over the tensioning disk 31 such that the axial sub-section 11*a* required for the operation protrudes the bottom edge of the tensioning disk 31. In this position, the pipe is clamped by spreading the jaw segments 34 and is then rotated at a rotational speed of between 20 and 300 rpm by means of the drive motor 28.

The bead is integrally formed by means of the pre-forming roller tool 9, as is explained above with reference to FIGS. 5 to 12. This is followed by the second processing stage, namely the production of the partly solid or solid flange by means of the final-forming roller tool 18 without interrupting the rotation of the pipe 11. This process is described above with reference to FIGS. 14 to 17. After finishing the flange, also the final-forming roller tool 18 is returned to the original position. The rotation is stopped. After loosening the tensioning disk 31, the pipe 11 with the integrally formed flange according to FIGS. 1 to 4 can be removed from the device.

Not shown in the figures are driving elements, valves and the similar units for the programmed control of the entire device, which enable a fully automatic production process based on predefined data. These units and the controller are preferably accommodated in a mount 37 covered with a sheet metal housing.

The device according to FIGS. 18 and 19 is only suited for integrally forming a flange to one end of a pipe 11.

For economical reasons, particularly in straight pipe sections, it may be advantageous to integrally form flanges on both end of the pipe section at the same time.

Figure 20:
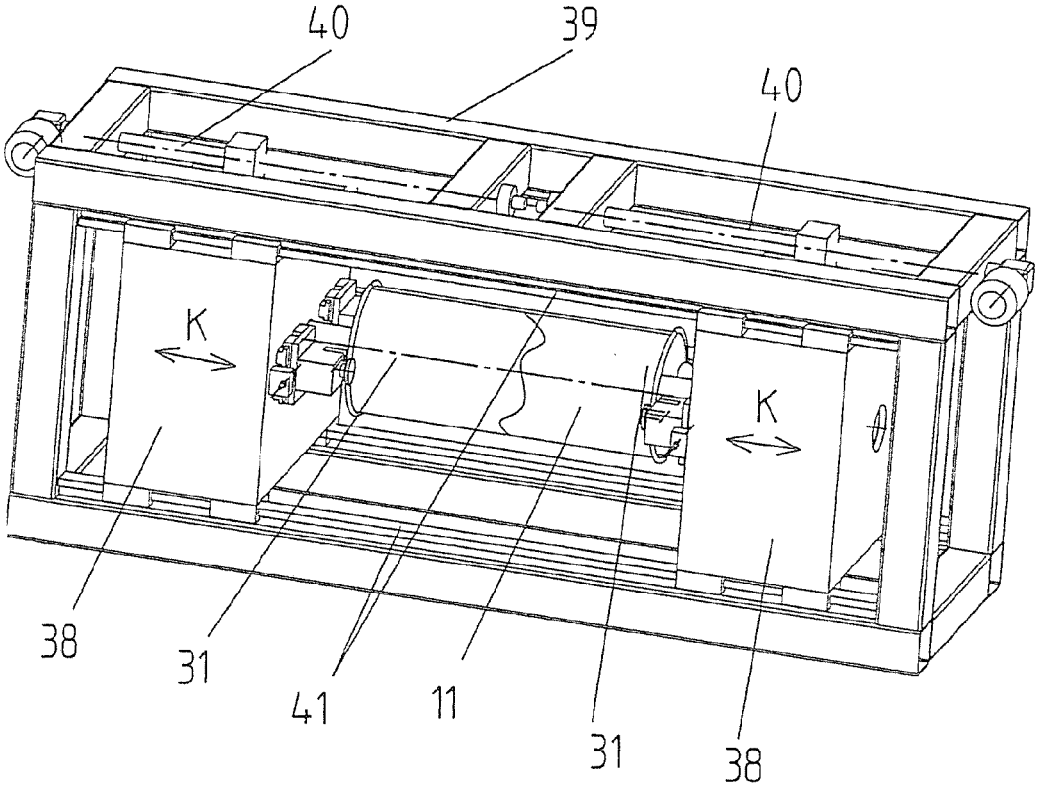
FIG. 20 is a perspective illustration of a device for the integral forming of flanges at both ends of a pipe.

For this purpose, the device illustrated in FIG. 20 is provided, wherein two forming units 38, the design of which corresponds to the device according to FIGS. 18 and 19, are disposed horizontally in a pipe mount 39, so that the tensioning disks 31 are disposed opposite from one another.

At least one of the two forming units 38 can be horizontally displaced in the support rails 41 in the direction of the double arrow K with the help of driven threaded spindles 40. In this way, the distance of the two forming units 38 can be adjusted in accordance with the pipe length, wherein at least one forming unit 38 is axially displaceable for inserting and removing the pipe 11.

Figure 21:
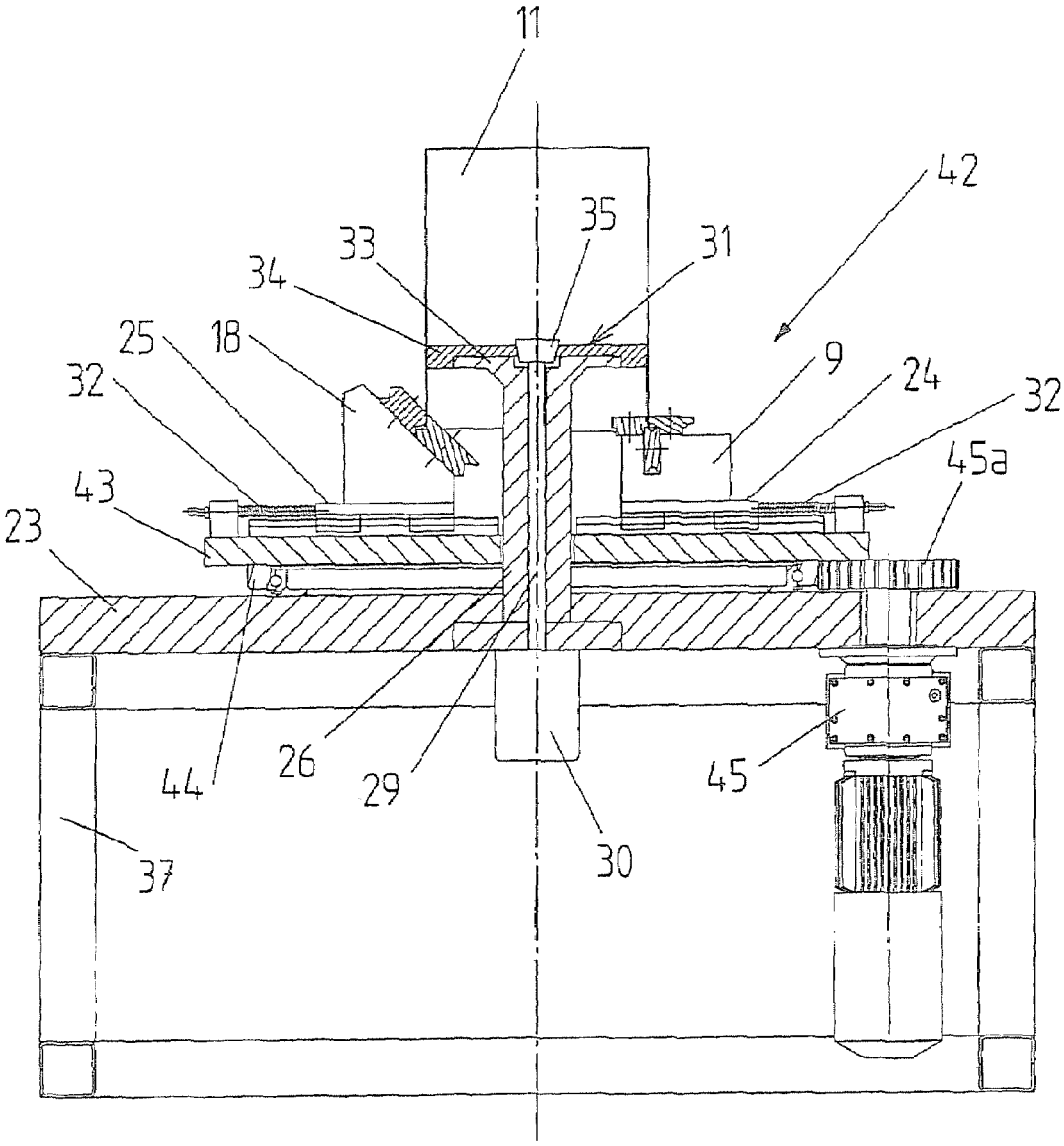
FIG. 21 is an axial section of a complete device for the integral forming of a flange according to the second exemplary embodiment.
Figure 22:
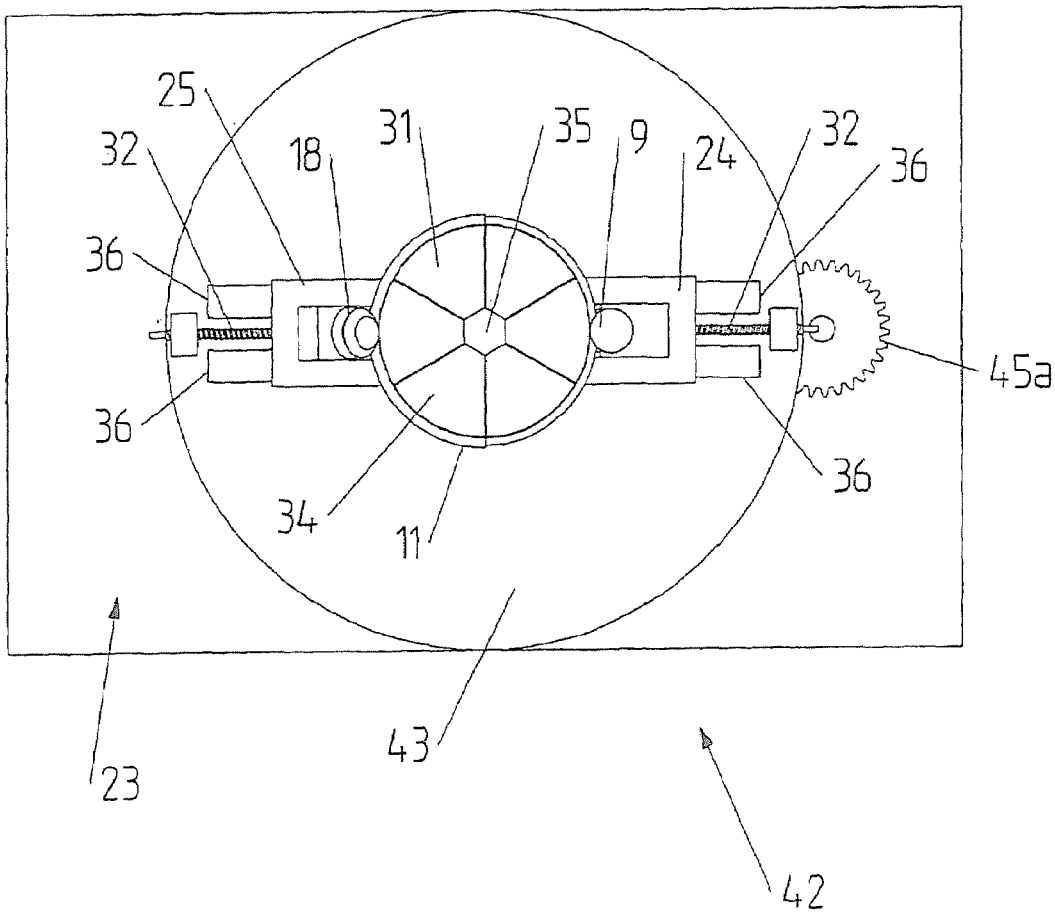
FIG. 22 is a top view of the device according to FIG. 21.

Another variant for producing a flange that is integrally formed on the pipe, the variant being referred to as the forming unit 42, is illustrated in FIGS. 21 and 22.

In this exemplary embodiment, which is particularly suited for processing non-rectilinear pipe sections, the pipe is stationary during processing, while the roller tools 9 and 18 are provided on a rotary table 43 driven by the gear motor 45 and rotating about the axis of the pipe 11.

The device for clamping the pipe 11 is designed similar to that provided in the device according to 18 and 19. Here as well, a tensioning disk 31 comprising jaw segments 34 serves the bracing of the pipe 11, the segments being radially displaceable with the help of a polygonal bolt 35, the pull rod 29 and the cylinder 30. The base disk 33 carrying the jaw segments 34 is provided at the upper end of the hollow shaft 26 through which the pull rod 29 extends. Unlike in the device according to FIGS. 18 and 19, the hollow shaft 26 is firmly connected to the base plate 23 of the mount 37.

The rotary table 43 is rotatably about the hollow shaft 26. At the bottom thereof, it is provided with a rotating rim gear 44, which is connected to the pinion 45*a* of the gear motor 45.

On the rotary table 43, the carriages 24 and 25 with the roller tools 9 and 18 are disposed, the carriages being radially displaceable by adjustment spindles 32, wherein the design and configuration of the tools correspond to those according to FIGS. 18 and 19.

The forming unit 42 shown in FIGS. 21 and 22 is above all suited for forming flanges on molded parts or awkwardly shaped pipes, since these do not require rotation during the flanging operation.

During the one-sided forming of a flange by means of the devices according to FIGS. 18 and 19 or 21 and 22, it is very important that the pipe 11 is clamped with extremely high stability by the tensioning disk 31 since the pipe 11 must not only be tensioned radially, but must also be braced against the impact of the axially displaceable roller tools 9 and 18. Otherwise, complete and precise forming of the flanges is not possible. When simultaneously forming the flanges on both pipe ends of the device according to FIG. 20, clamping is less critical because the axially acting forces applied by the roller tools offset one another.

The clamping of relatively thin-walled pipes with one-sided integral flange formation is especially critical because the tensioning disk 31 to be inserted in the pipe, including the jaw segments 34 of said disk, can radially deform the pipe if the jaw segments apply a higher amount of pressure. The pressure acting in the radial direction, however, can be reduced only to a limited extent because the pipe during processing must be fixed in place non-rotatably by the friction force.

Figure 23:
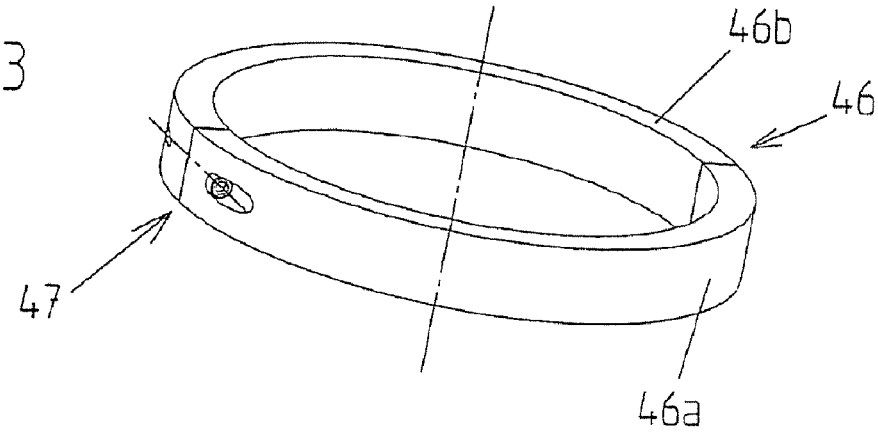
FIG. 23 is a perspective illustration of a pressure ring.
Figure 24:
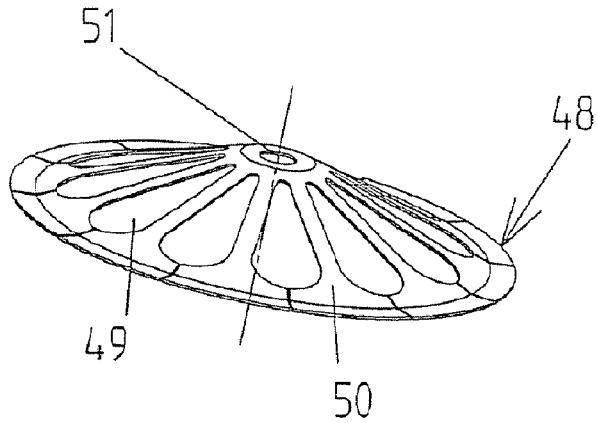
FIG. 24 is a perspective illustration of a spring-loaded disk.
Figure 25:
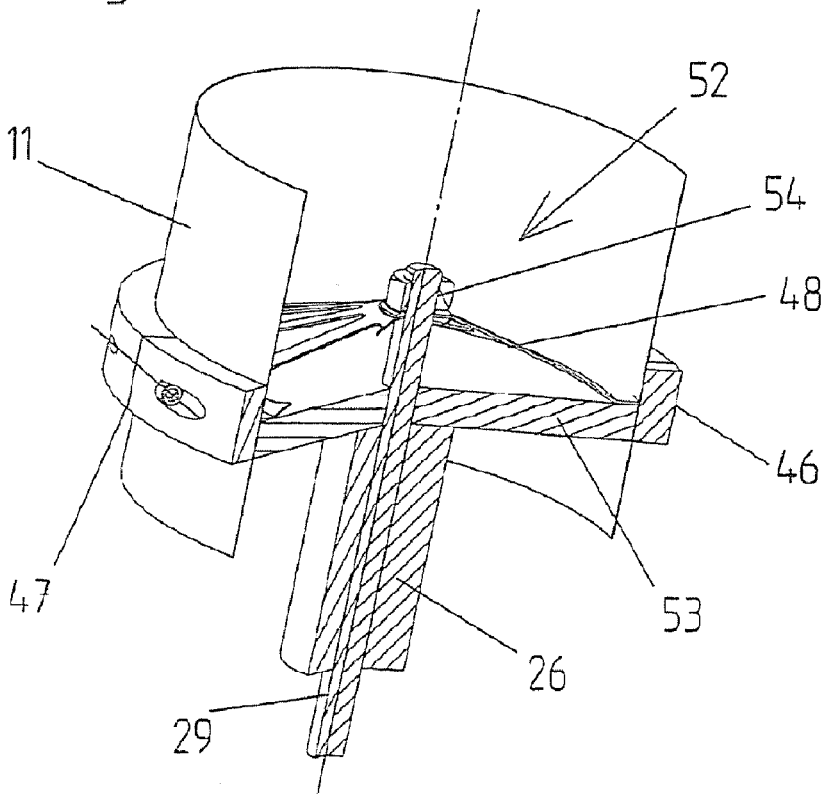
FIG. 25 is a perspective illustration of a clamping device inserted in the end of a pipe comprising the elements according to FIGS. 23 and 24.

For the one-sided integral forming of flanges on thin-walled pipes therefore a modified clamping device is proposed, which is illustrated in FIGS. 23 to 25.

So as to prevent pipe expansion under the action of the tensioning disk, which is to say so as to produce counter-pressure, a pressure ring 46 is provided, which is attached at the height of the tensioning disk on the outside of the pipe 11. For this purpose, the pressure ring 46 is configured in two pieces. The two parts 46*a* and 46*b* can be connected to one another after being slid onto the pipe 11, for example by means of screw assemblies on 47. Instead of a second screw assembly, it is also conceivable to provide an articulated connection of the parts 46*a* and 46*b*, for example by means of a hinge or the like.

In this exemplary embodiment, a conical spring-loaded disk 48 configured as a disk spring is provided as the tensioning disk, which is divided into radially extending tensioning fingers 50 provided in a radial shape from the center bore 41 by means of radial slots 49. This spring-loaded disk 48 sits on a pressure plate 53 to be inserted into the inside of the pipe, the plate being attached to the upper end of the hollow shaft 26. Again, a pull rod 29 axially extending through the hollow shaft 26 and the pressure plate 53 serves the actuation of the spring-loaded disk 48, the upper end of the rod penetrating the center bore 51 of the spring-loaded disk 48 and being connected thereto by a nut 54.

If a pulling force is applied to the pull rod 29 by means of the cylinder, which is not shown, the tensioning fingers 50 are spread and rest against the inside wall of the pipe 11 in a force-fit manner, wherein they grab the pipe wall when an appropriate pulling force is applied. This is possible because the pressure ring 46 prevents radial evasion of the pipe wall, thus fixing the pipe 11 in place. The spring-loaded disk 48 allows the pulling force applied by the pull rod 29 to be multiplied, wherein as the cone angle of the spring-loaded disk 48 flattens the spreading force of the spring-loaded disk 48 increases.

LIST OF REFERENCE NUMERALS

1 Pipe wall
- 1*a* Inner wall surface
- 1*b* Outer wall surface

2, 3, 4 Pipe wall
5, 6, 7, 8 Flange
9 Pre-forming roller tool
10 Outer rim or edge of the pipe end
11 Pipe
- 11*a* Axial sub-section
- 11*b* Pipe axis

12 Receiving gap between rollers 13 and 15
13 Roller of the pre-forming roller tool 9
- 13*a* Cylindrical section
- 13*b* Cylindrical section
- 13*c* Axis

14 Roller of the pre-forming roller tool 9
- 14*a* Annular groove
- 14*b* Axis

15 Roller of the pre-forming roller tool 9
- 15*a* Cylindrical section
- 15*b* Annular groove
- 15*c* Cylindrical section
- 15*d* Axis

16 Formed groove
17 Bead
18 Final-forming roller tool
19 Forming roller
- 19*a*, 19*b* Annular surfaces

20 Forming roller
- 20*a*, 20*b*, 20*c* Annular Surface

21 Receiving gap
22 - - -
23 Base plate
25 Tool carriage
25 Tool carriage
26 Hollow shaft
27 Bearing block
- 27*a* Tapered roller bearing

28 Drive motor
- 28*a*, 28*b* Gear wheels

29 Pull rod
30 Dual-action cylinder
31 Tensioning disk
32 Adjusting spindles
33 Base disk
34 Jaw segments
- 34*a* Inner jaw ends

35 Conical polygonal bolt, clamping cone
36 Guide rails
37 Mount
38 Forming unit
39 Pipe mount
40 Threaded spindles
41 Support rails
42 Forming unit
43 Rotary table
44 Rotating rim gear
45 Drive motor
- 45*a* Gear wheel

46 Pressure ring
- 46*a*, 46*b* Parts of the pressure ring 46

47 Screw assembly
48 Spring-loaded disk
49 Slot
50 Tensioning finger
51 Bore
52 Spring-loaded tensioning disk
53 Pressure plate
54 Nut
A to K Arrows to designate directions of movement

The invention claimed is:

1. A method for integrally forming a flange to the end of a round or oval pipe made of thin-walled sheet metal, the pipe being clamped close to the end thereof such that it protrudes beyond the clamping with an axial sub-section, the axial sub-section being formed into a flange protruding outward from the pipe by means of an associated roller tool upon rotation of the pipe or of the roller tool, comprising the steps of:

in a first stage for material accumulation purposes, forming the end of the axial sub-section of the pipe into a coil comprising at least one layer and having a substantially circular cross-section; and in a second stage, compressing the coil so as to produce a solid flange by a final-forming roller tool, comprising of mutually engaging forming rollers which are advanced toward the coil upon the rotation of at least one of the pipe or the final forming roller tool, whereby the forming rollers in their final positions delimit a gap that corresponds to a desired flange profile and whereby non-driven forming rollers are revolving freely.

2. The method according to claim 1, further comprising forming the end of the axial sub-section of the pipe into the coil while axially advancing a pre-forming roller tool at the same time.

3. The method according to claim 1, wherein the pre-forming roller tool is advanced so far that a coil comprising at least two layers and having a substantially spiral-shaped cross-section is produced, which in the second stage is compressed into a solid flange.

4. The method according to claim 3, wherein the pre-forming roller tool continues to be advanced after the formation of the coil has been completed to compress the bead.

5. The method according to claim 1, wherein the axial advancement of the pre-forming roller tool ranges between approximately 0.2 and approximately 2 mm per revolution of the pipe or of the pre-forming roller tool.

6. The method according to claim 1, wherein at least one of the pipe and the pre-forming roller tool is stationary and at least one of the pipe and the pre-forming roller tool is rotated in relation to the other.

7. The method according to claim 6, wherein the rollers of the pre-forming roller tools are freely revolving and are not driven.

8. The method according to claim 1, wherein the forming rollers are advanced toward one another at an angle of approximately 45° in relation to the pipe wall, the advancement speed of the forming rollers ranging between approximately 0.1 and approximately 2 mm per revolution of the pipe or of the final-forming roller tool.

* * * * *